US010334969B1

(12) United States Patent
Roan et al.

(10) Patent No.: US 10,334,969 B1
(45) Date of Patent: Jul. 2, 2019

(54) MODULAR DISPLAY

(71) Applicant: Art Guild, Inc., West Deptford, NJ (US)

(72) Inventors: Joseph Roan, Media, PA (US); Ivan Letinic, Manalapan, NJ (US); Konrad Giersz, Philadelphia, PA (US); Joon Kweon Hwang, Dumont, NJ (US)

(73) Assignee: Art Guild, Inc., West Deptford, NJ (US)

( * ) Notice: Subject to any disclaimer, the term of this patent is extended or adjusted under 35 U.S.C. 154(b) by 0 days.

(21) Appl. No.: 15/966,256

(22) Filed: Apr. 30, 2018

(51) Int. Cl.
*A47F 5/10* (2006.01)
*A47F 7/00* (2006.01)

(52) U.S. Cl.
CPC ..... *A47F 5/10* (2013.01); *A47F 7/0014* (2013.01)

(58) Field of Classification Search
CPC ..... A47F 5/10; A47F 5/112; A47F 5/0062; A47F 7/0014; A47F 7/163; A47F 7/0042; A47F 7/145; A47F 7/0064; B25H 3/04
USPC ..... 211/41.1, 41.2, 41.12, 41.13, 41.17, 211/41.18, 42
See application file for complete search history.

(56) References Cited

U.S. PATENT DOCUMENTS 601,753 A * 4/1898 Kaiser ..... A47B 81/04 211/41.2
662,824 A * 11/1900 Rosher ..... A47F 5/112 211/69
819,989 A 5/1906 Gilbert
945,985 A * 1/1910 Schroeder ..... A47F 7/163 211/45
1,006,486 A * 10/1911 King ..... G03B 21/54 211/41.13
1,621,327 A * 3/1927 Lehman ..... H01M 4/22 211/26.2
1,660,210 A * 2/1928 Schaefer ..... A47F 7/0064 211/41.2
1,960,095 A 5/1934 Tonnesen
2,839,200 A 6/1958 Easterwood
2,873,859 A 2/1959 Gates
3,200,957 A 8/1965 Morin
3,282,437 A * 11/1966 Hansen ..... A47F 7/0064 211/41.7
3,315,814 A 4/1967 Korsen
3,472,387 A 10/1969 Olsen
3,554,429 A * 1/1971 Cohen ..... B65D 5/48046 206/456
3,666,115 A * 5/1972 Turner ..... A47F 7/0042 211/50
3,702,136 A * 11/1972 Albertson ..... B25B 13/56 206/376
3,822,019 A * 7/1974 Baatz ..... B25B 13/56 210/469
3,837,477 A * 9/1974 Boudreau ..... B65D 5/50 206/376

(Continued)

*Primary Examiner* — Patrick D Hawn
(74) *Attorney, Agent, or Firm* — Volpe and Koenig, P.C.

(57) ABSTRACT

A product holder has a base extending between a forward wall and a rearward wall. The product holder has a plurality of product holding slots positioned between a forward wall and a rearward wall. The product holder has at least two reliefs that are arranged to receive a placard. The product holder is provided in a mirror image format so that two product holders can be attached to a structural support to define a product display.

13 Claims, 12 Drawing Sheets

(56) References Cited

U.S. PATENT DOCUMENTS 3,907,116 A * 9/1975 Wolf ..... G11B 23/023 206/387.15
4,312,548 A * 1/1982 Posso ..... A47B 88/90 312/9.52
4,446,974 A * 5/1984 Ott ..... A47F 7/163 211/45
4,518,085 A * 5/1985 Chisholm ..... H05K 13/0069 206/454
D281,209 S * 11/1985 Burns ..... D6/310
4,682,697 A 7/1987 Cohen
5,339,547 A * 8/1994 Fogel ..... G09F 1/10 40/124.01
5,505,316 A 4/1996 Lee
5,762,213 A * 6/1998 Heneveld, Sr. ..... A47B 57/485 108/109
5,819,922 A * 10/1998 Martin, Jr. ..... B42F 15/007 206/214
5,915,571 A * 6/1999 Czalkiewicz ..... A47F 7/145 211/128.1
5,938,040 A 8/1999 Goodwin et al.
6,131,521 A * 10/2000 Nelson ..... A47B 77/022 108/27
6,161,704 A * 12/2000 Stravitz ..... A47F 7/141 211/189
6,286,689 B1 9/2001 Sherwood et al.
6,427,853 B2 8/2002 Brozak, Jr.
6,910,590 B2 6/2005 Meier
6,942,108 B2 * 9/2005 Wons ..... A47F 7/145 211/128.1
7,581,650 B1 * 9/2009 Shen ..... A47F 7/145 211/55
7,987,975 B1 8/2011 Lee
7,987,981 B1 8/2011 Lee
8,684,191 B2 4/2014 Hosey
8,844,732 B2 9/2014 Wu
2004/0065629 A1 * 4/2004 Hunt ..... G11B 33/0466 211/40
2011/0187247 A1 * 8/2011 Carter ..... A47F 5/08 312/246
2011/0303624 A1 * 12/2011 Letinic ..... A47F 7/0042 211/59.2

* cited by examiner

MODULAR DISPLAY

FIELD OF INVENTION

The present invention pertains generally to modular display structures that can be configured according to the physical configurations of the supported products. More particularly, the present invention relates to structural components that are configured to enable multiple display formats and to connect multiple display structures together.

BACKGROUND

Retail product displays can be free standing or counter supported structures. The problem with the prior art structures, especially those counter displays intend for use with upstanding products, is that they are often designed for a specific product and are not adjustable or combinable with each other to accommodate product changes or alternative display arrangements.

The problem is further compounded by the fact that retailer often prefers to keep a consistent theme among their displays. If the displays are not flexible enough to allow different configuration and grouping of displays, the retail merchant may be confronted with additional display expenses because of the need to purchase entirely new displays.

SUMMARY

The present solution to the above problem provides flexible display components for upstanding products that are combinable to produce different display arrangements. Furthermore, the individual components are designed to make disassembly and reconfiguration of the display units easier. The pin and lock system for connecting the connecting the individual components also put less stress on the components during disassembly and reconfiguration.

BRIEF DESCRIPTION OF THE DRAWING(S)

FIG. 1 illustrates one form of a display with upstanding products in the display and an option point of sale billboard;

FIG. 2 illustrated the billboard of FIG. 1 separately from the display;

Figures 6, 6A, 6B:
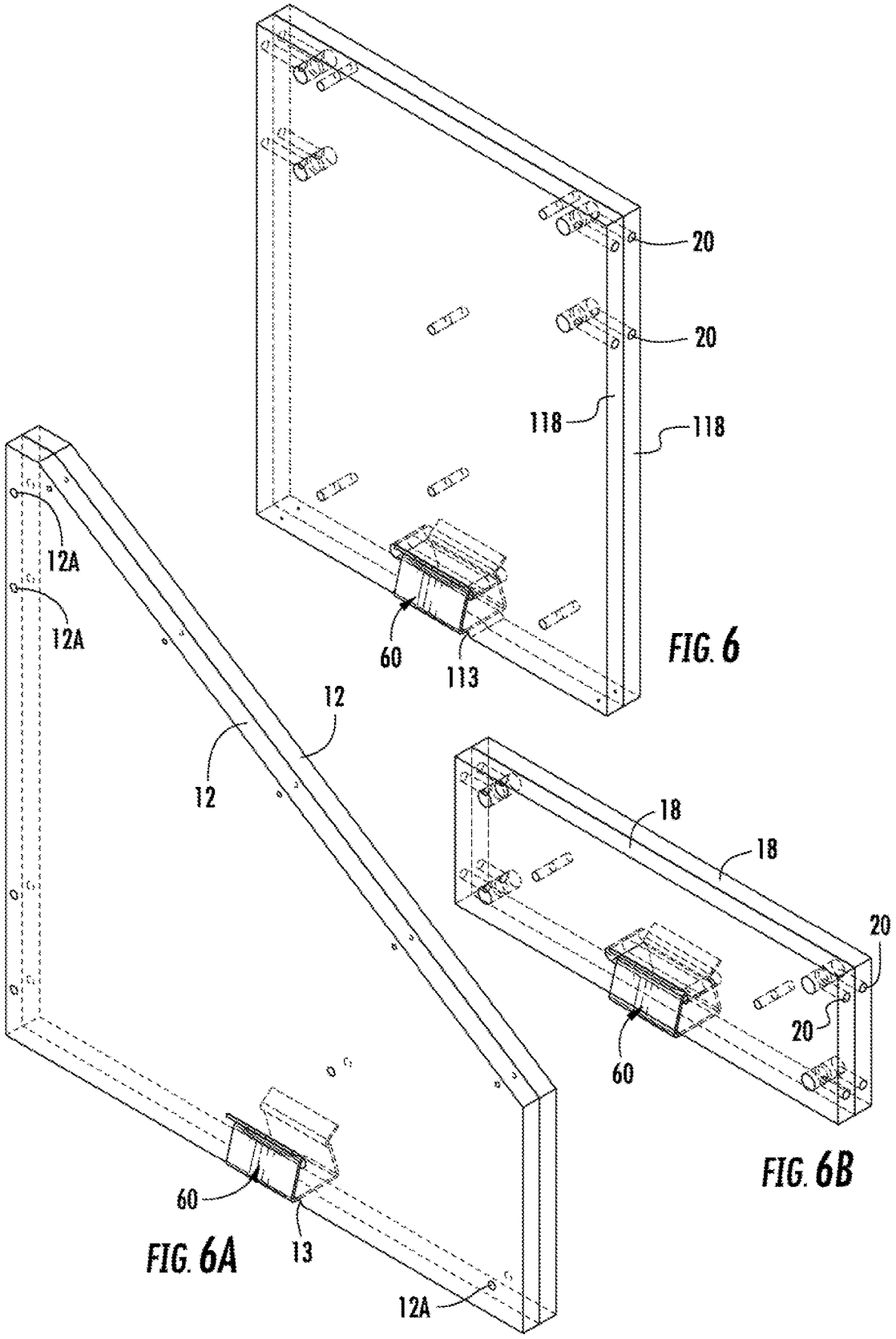
Figure 7:
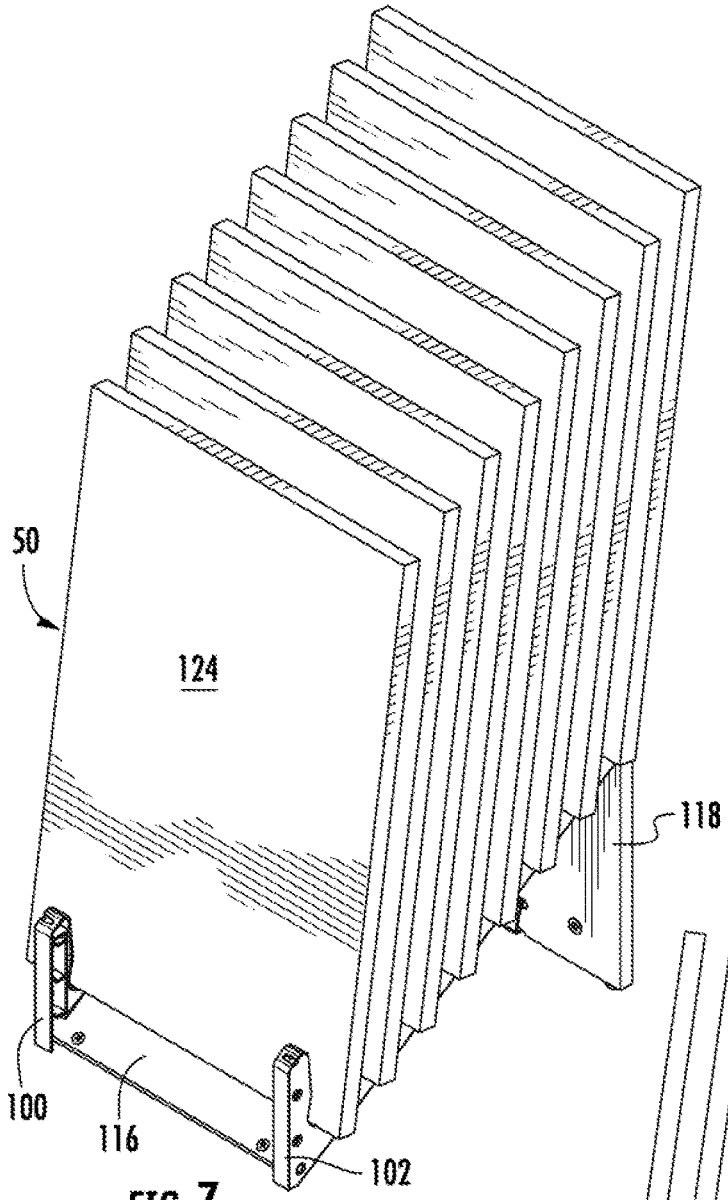
Figure 8:
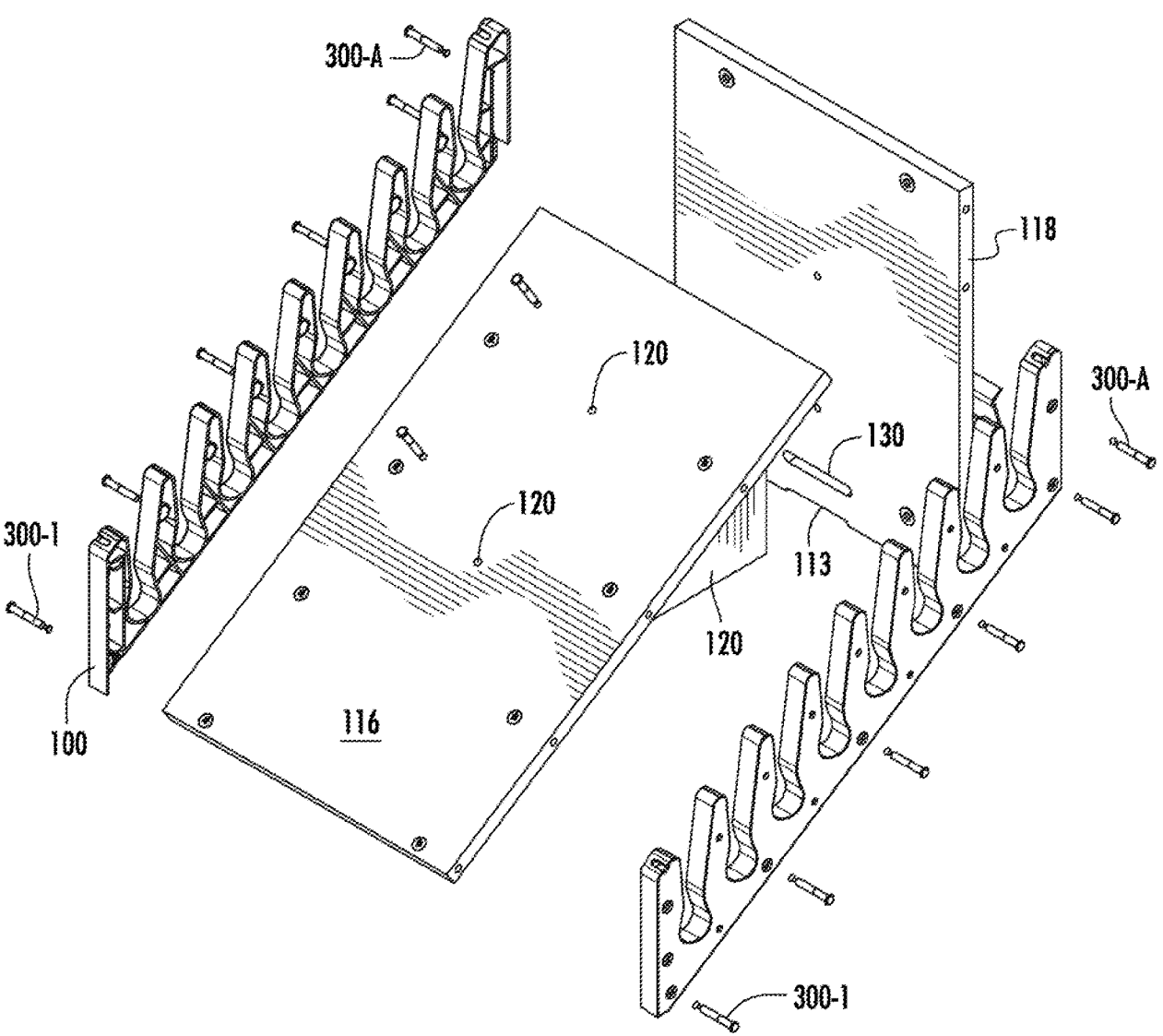
Figures 9, 9A, 9B:
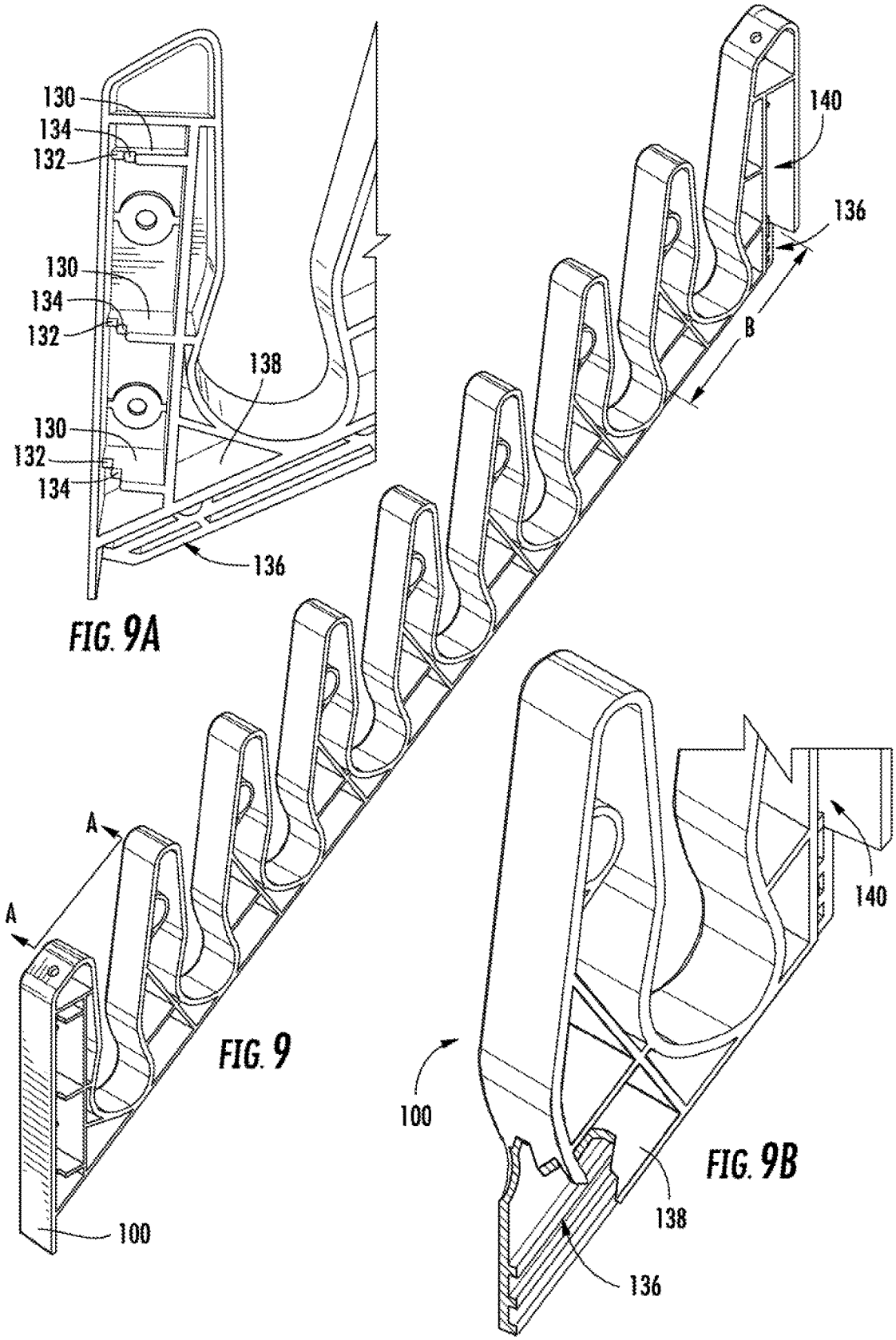
Figure 10:
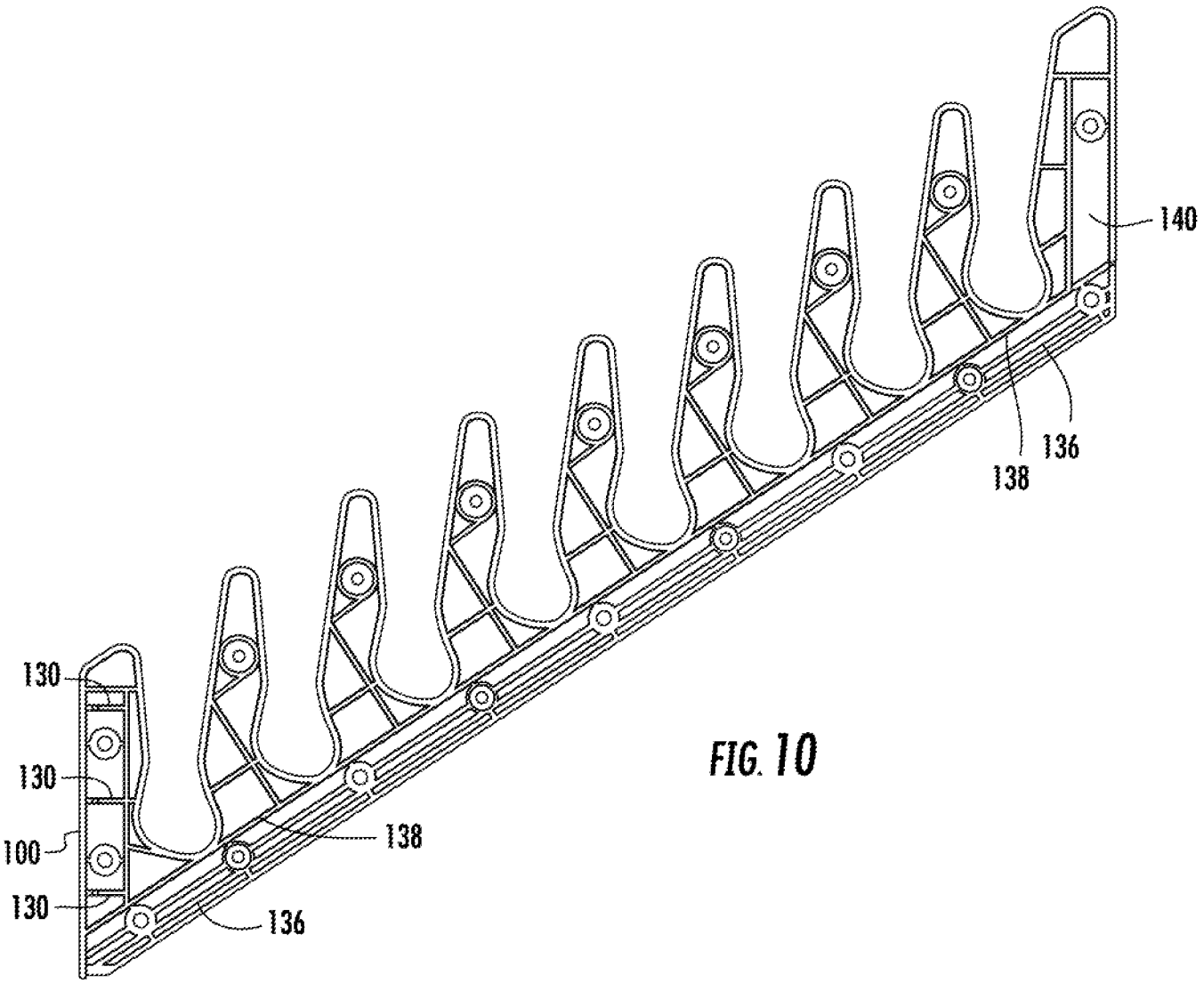
Figure 13:
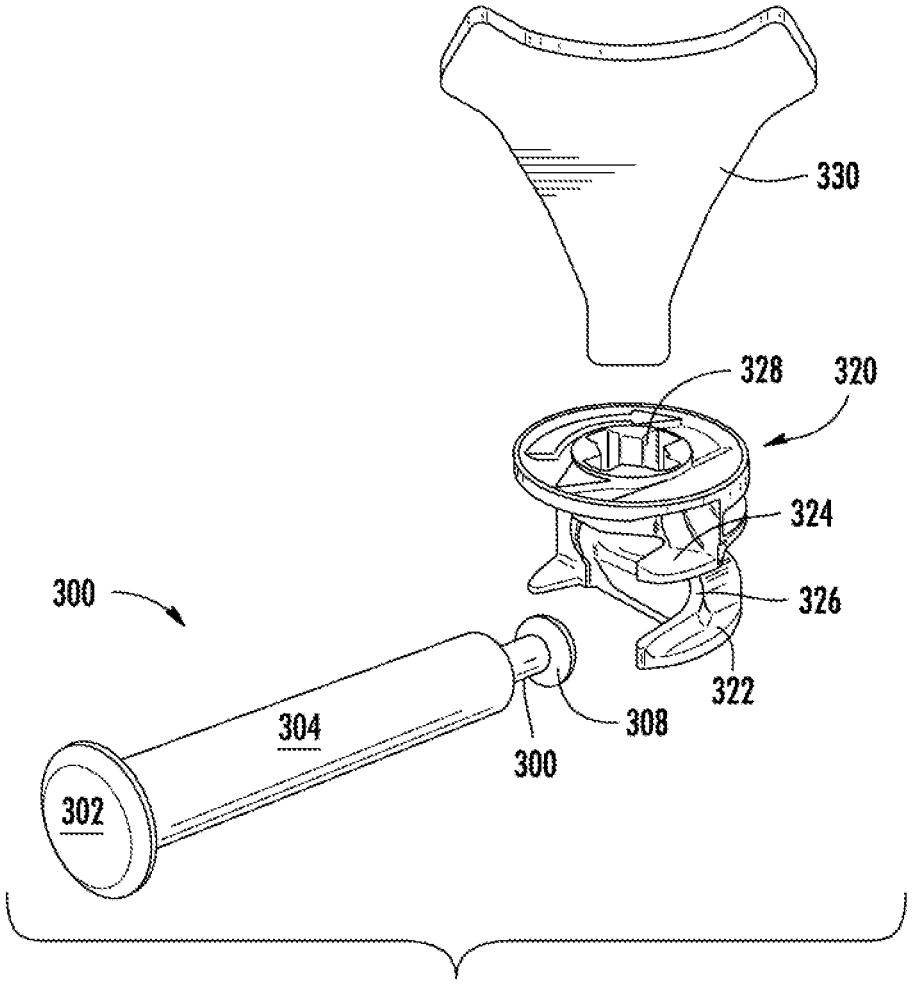

FIGS. 6 through 6 B illustrate the use of the joining clip to connect displays;

FIG. 7 illustrated a perspective view of another display where the displayed products are upstanding but not confined by side walls;

FIG. 7 A is a side view of the display in FIG. 7;

FIG. 8 is an exploded view of the display in FIG. 7;

FIG. 9 a perspective view of a preferred product support for use with edge mounting to a support structure;

FIG. 9 A is an side view in the direction of the arrow A on the forward end of the product support in FIG. 9;

FIG. 9 B is a fragmentary view in the direction of the arrow B on the rearward product support in FIG. 9;

FIGS. 1 through 12 illustrates an alternative product support that is usable with a support structure where edge mounting is not available;

FIG. 13 illustrates a connecting pin and cam lock, with a locking and unlocking tool, that is suitable for releasable securing the display components.

DETAILED DESCRIPTION OF THE PREFERRED EMBODIMENTS

Figure 1:
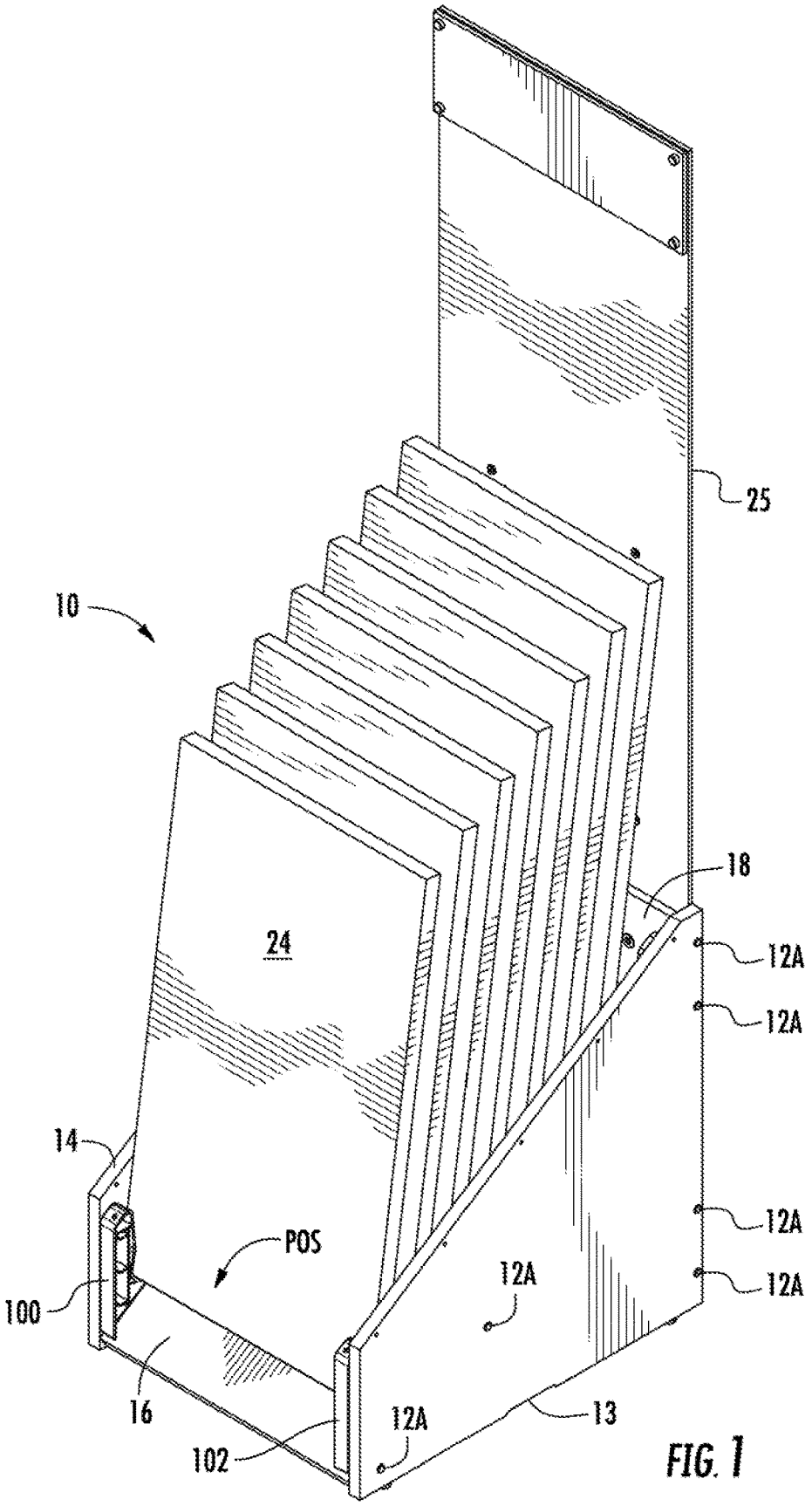

FIG. 1 illustrates a display 10 with side walls 12 and 14, bottom plate 16 and rear spacer or spreader bars 18. FIG. 1 also includes an optional point of sale billboard 25 that can be added to the back of a display to announce the product, the manufacturer or even special pricing deals.

Figure 3:
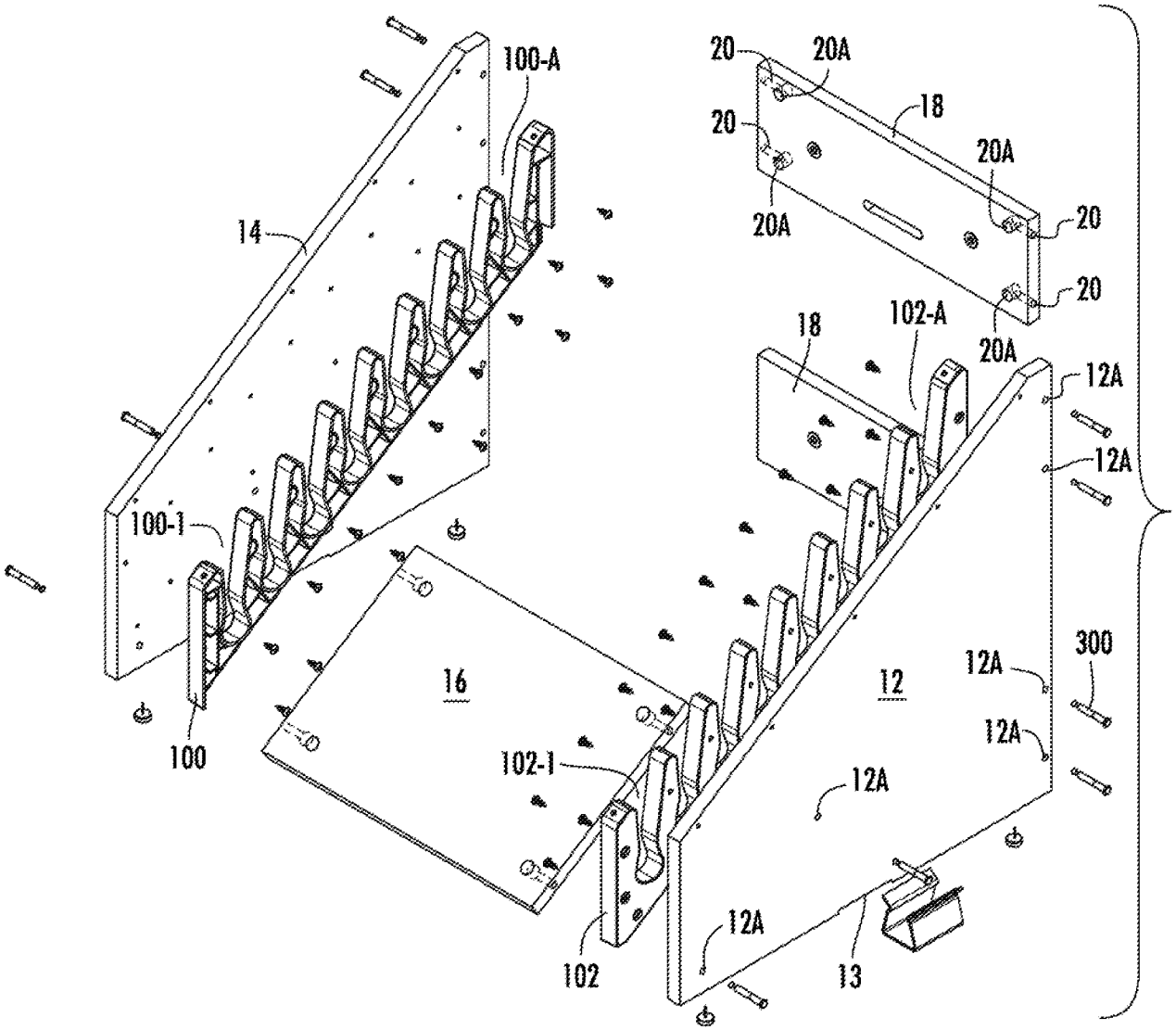
FIG. 3 is an exploded view of the display in FIG. 1 without the product and the billboard.

With reference to FIGS. 1 and 3, each of the sidewalls 12 and 14 supports a respective product holder 100 and 102 that has a number of individual product holding slots 100-1 to 100-X, 102-1 to 102-X that are positioned between forward and rearward generally upright walls. Each slot 100-1 to 100-X, 102-1 to 102-X is dimensioned to receive a respective product 24 and display it in an upright or upstanding orientation.

With reference to the exploded view in FIG. 3, the components of the display are illustrated in more detail. The side walls 12 and 14 are spaced apart in the horizontal or width direction by the bottom plate 16 and the spacer bar 18. The spacing of walls 12 and 14 can be adjusted by increasing or decreasing the width of the bottom plate 16 and spacer bars 18. The product holders 100 and 102 are mirror images of each other and designed for direct attachment to a respective side wall 12 or 14, or an edge as will be explained with reference to the embodiment in FIG. 7. In the embodiment of FIG. 3, the product holders 100 and 102 can be fastened directly to a respective side wall 12 or 14 with pan head screws. The bottom plate 16, in addition to spacing the walls, presents a finished appearance when product is removed from the product holders 100 and 102. Each product holding slots 100-1 to 100-X, 102-1 to 102-X can be customized according to the product's dimensions. For larger products, fewer holding slots may be preferred; for smaller products that can be more densely displayed, more holding slots may be desirable.

Figure 2:
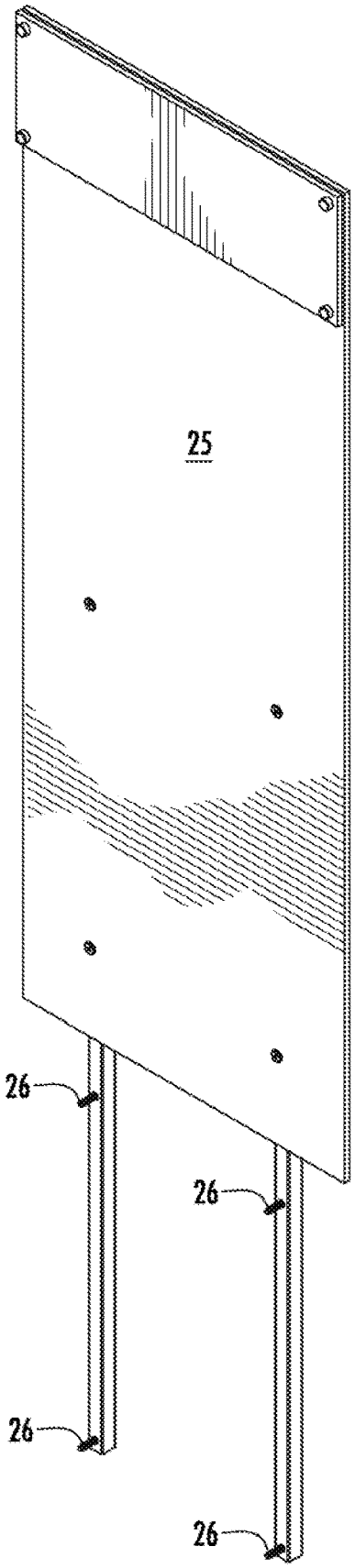
Figure 4:
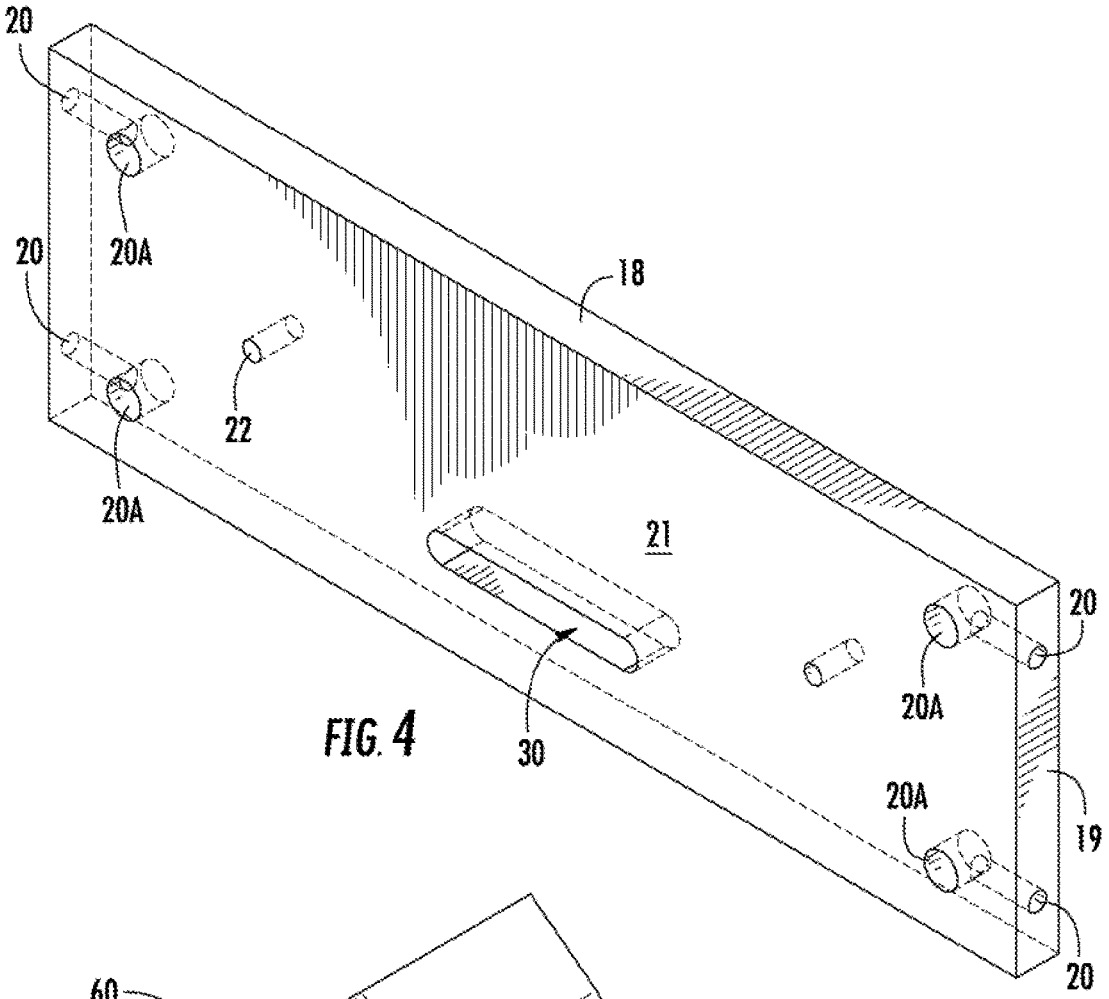
FIG. 4 illustrates one style of a spacer or spreader that is used to determine the width of a display in certain configurations.

With reference to FIG. 4, a preferred method of assembling the structural components will be explained. The horizontal or width defining members, like the bottom plate 16 or spacer bars 18, have passages or channels 20 that extend inwardly from the side edges 19. Each passage or channel 20 extends inwardly until it intersects a respective aperture 20A that extends in from the face 21. The side panels or walls 12 and 14 have apertures 12 A that align with the passages 20. This is illustrated in FIGS. 1 and 3 at 12 A so that walls 12 and 14 align with the two spacer bars 18. Still with reference to FIG. 4, the face 21 of spacer bar 18 may be provided with the apertures 22 that are spaced apart and dimensioned to align with and retain the pegs 26 that are associated with the billboard 25, as seen in FIG. 2.

The preferred hardware for connecting the structural components will be discussed in detail below.

Figure 5:
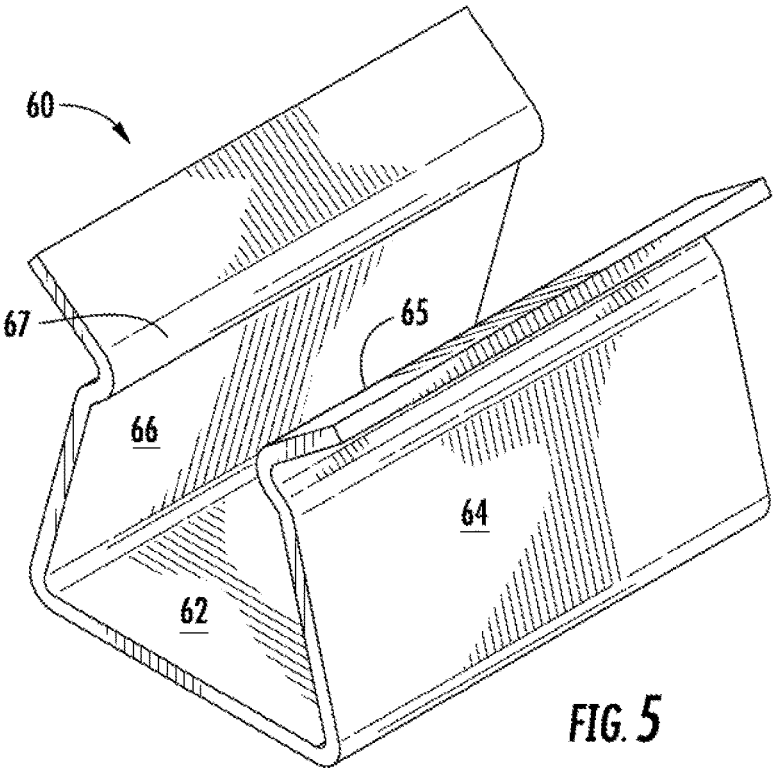
FIG. 5 illustrates a joining clip for connecting independent display units in a large display.

With reference now to FIGS. 4, 5, and 6 through 6 B, the spacer bars 18 have slots 30, the walls 12 and 14 have slots 13, the larger spacers 118 jave slots 113 that are dimensioned to receive one of the projections 65 or 67 associated with the clip 60 that is shown in FIG. 5. The floor 62 of clip 60 is dimensioned to maintain a space between the projections 65 and 67 for receiving the display parts between them. With reference now to FIGS. 1, 5, 6 and 7 A, the notches 13 and 113 are dimensioned to provide clearance for the base 62 of clip 60. This combination of slots 13, 30 and 113 and joining clip 60 makes it possible to connect displays back to back, side to side, or in different combinations as desired by the merchant. The clip 60 is preferable made from a PVC plastic extrusion that is cut to size, currently preferred to be about three inches in length, but his can be varied in accordance with the size of the display. Alternatively, it may be made from spring metal stock.

Figure 7A:
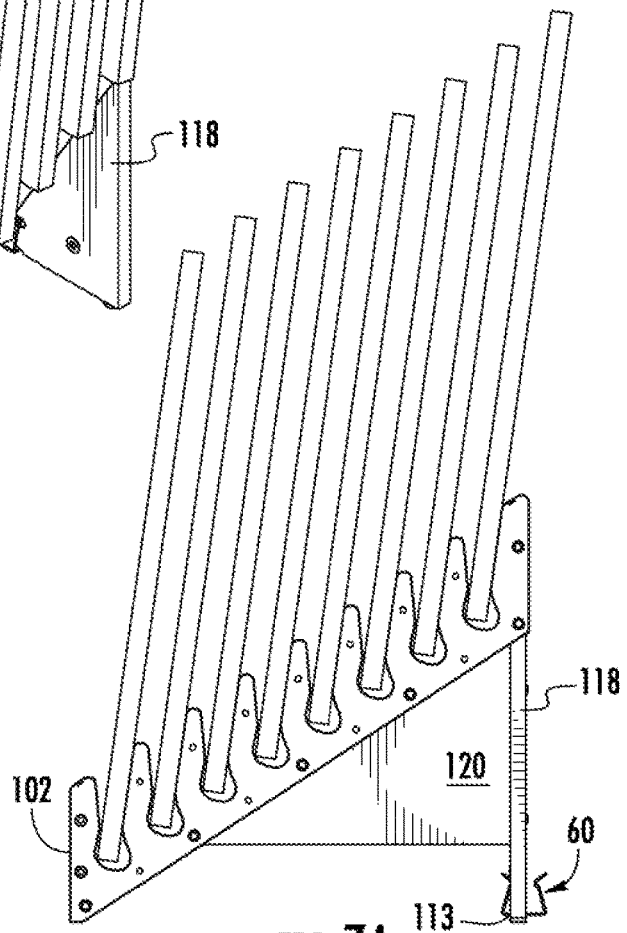

With reference to FIGS. 7, 7A and 8, an alternative embodiment 50 is illustrated. As shown in FIG. 7, this embodiment 50 does not have side walls and the products 124 may have a width greater than the display structure's width. In the exploded view of FIG. 8, it can be seen that the base panel 116 is a full panel that is supported by a middle rib 120 and a back panel 118. The base panel or plate 116 functions like the plate 16, and the spacer or back panel 118 that also attaches to the product holders 100 and 102 functions like the spacer bars 18. This configuration has a full back panel 118 which stabilization solidifies the structure from side to side and provides a joining point for the central rib 120. In this configuration, the product holders 100 and 102 rest on and are fastened to the sides of the base panel 116 with a plurality of pin and lock hardware parts 300-1 through 300-X. This configuration differs from the prior configuration in its use of the pin and lock hardware parts in place of the pan head screws. If desired, the earlier configuration may also use pin and lock hardware parts.

Figure 11:
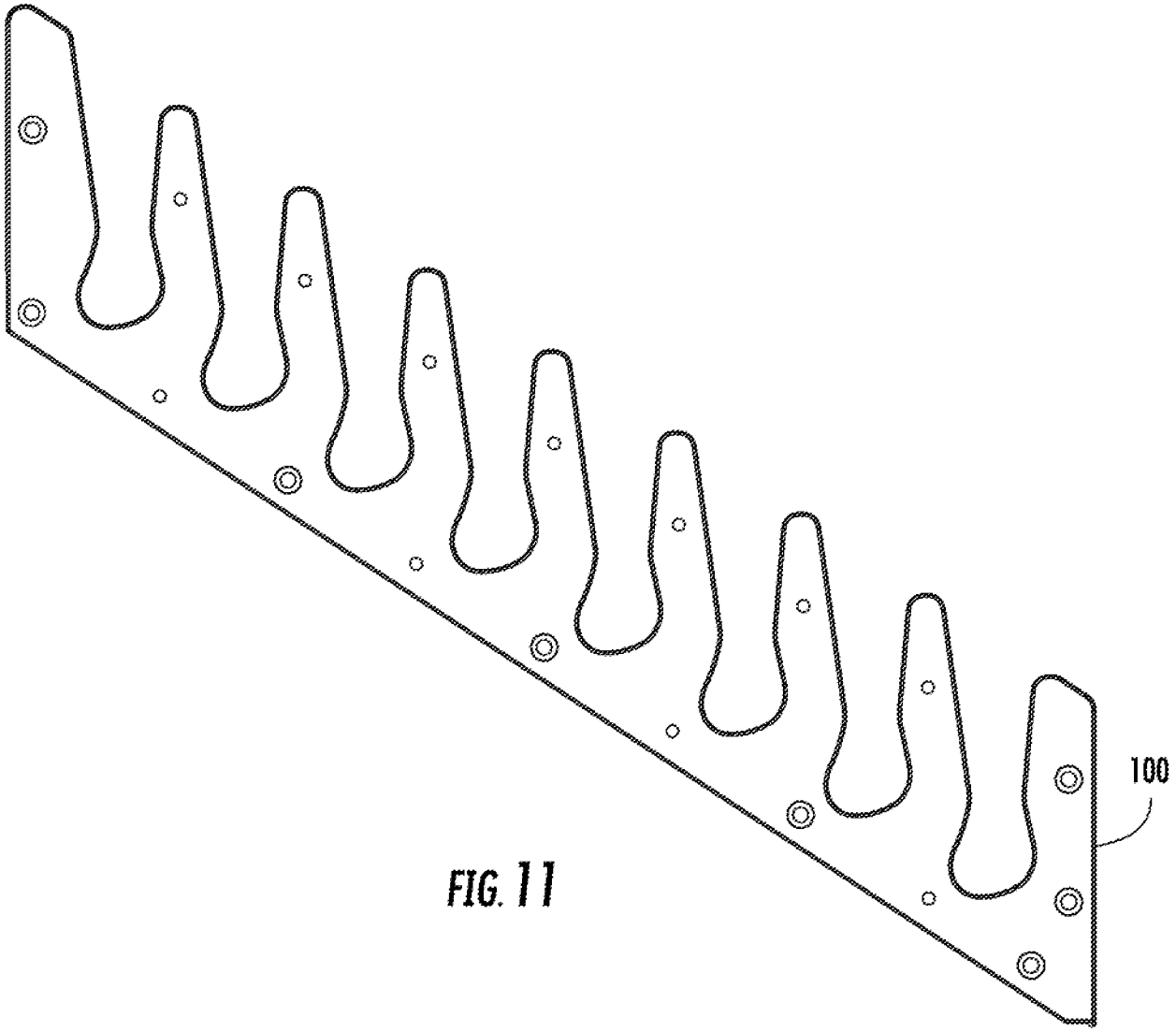

With reference to FIGS. 9, 9 A, and 9 B, additional features of the product holder 100 will be described. With reference to FIG. 9 A, there can be seen three horizontal plates 130. Each of these plates has reliefs or notches 132 and 134 that are above the lateral base 138 of the product holder 100 and form a position for inserting a "point-of-sale" face plate or placard on the display. The "point-of-sale" face plate is shown in phantom in FIG. 1 as POS. Altering the depth of the recesses or notches 132 and 134, permits different face plate sizes to be used with product holders 100 and 102. With reference to FIGS. 9, 9 A and 9 B, it can be seen that the side wall 136 and the base ledge 138 provide a receiving area for the base panel 116 when the product holders 100 and 102 are fastened to the side of the base panel 116. With reference to FIGS. 9, 9 B, and 10, it can be seen that the end of the product holder is provided with a recess 140 that is dimensioned to receive a spacer bar 18 or back panel 118. With reference to FIG. 11, it can be seen that the exposed surface of the product holders provide the display with a clean, finished surface when connected to the base panel 116.

Figure 12:
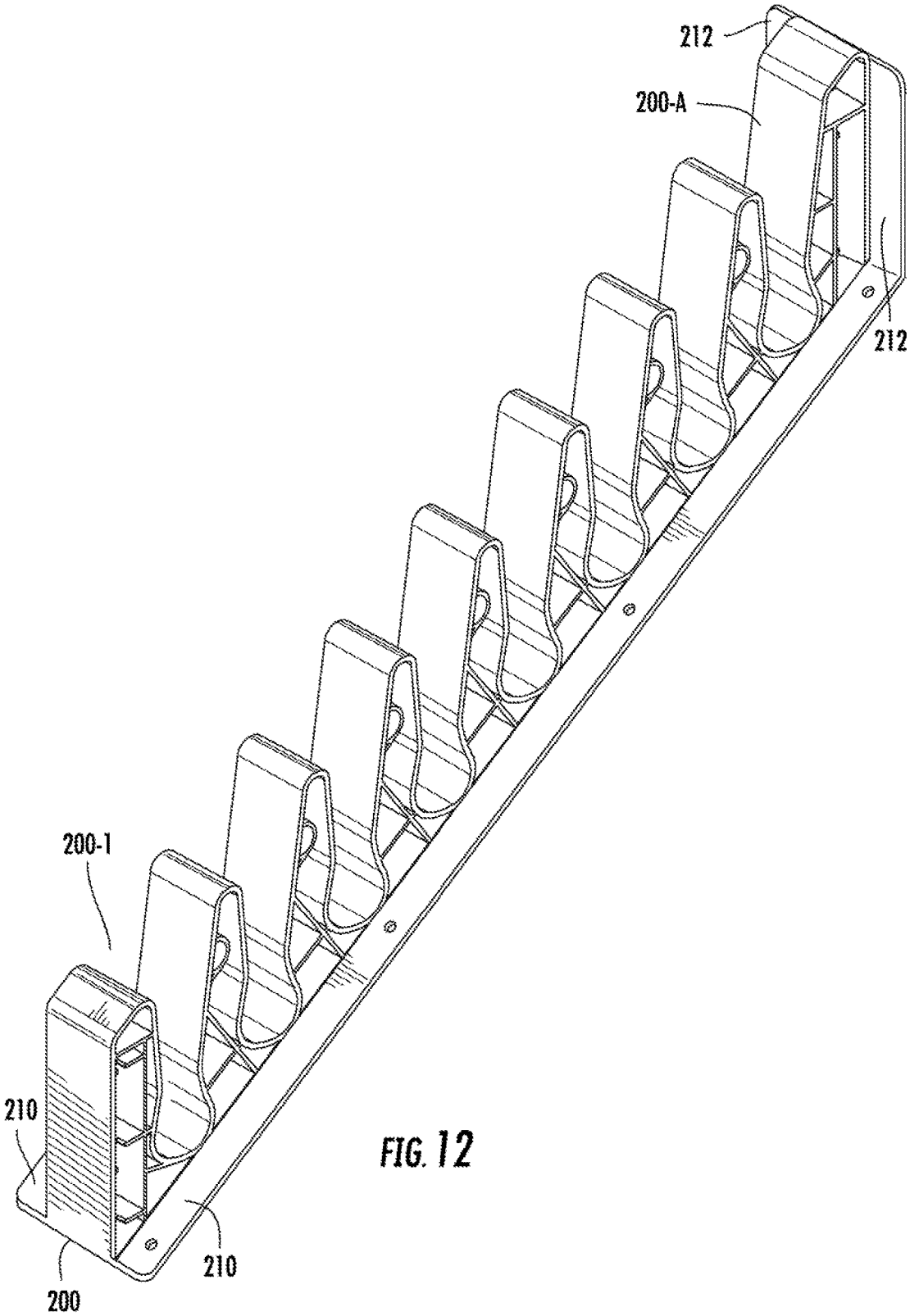

With reference to FIG. 12, a product holder 200 that is suitable for use as an intermediate holder, such as when there are small or odd sized products, is provided with a flat base 210 and a rear raiser 212, that extend on both sides of the product slots. The flat base 210 and rear raiser 212 are provided with a plurality of apertures for fastening it to plate 16 or 116. In all other respects the product holder 200 is configured like the product holder 100 and may use the optional fasteners in the same manner as product holder 100.

With reference to FIG. 13, there is illustrated a preferred pin and lock hardware arrangement for connecting the various structural parts of the display. The pin 300 has a larger finished head 302 that abuts on structural part and a pin 340 that fits within a channel 20 in a second structural part. The recess 306 and the smaller head 306 through the channel 20 and into a aperture 20 A. The cam lock 320 fits into the aperture 20 A and surrounds the recess 306 and the smaller head 306. When the cam lock 320 is rotated with the tool 330, the the prongs 322 and 324 along with the gap 326 rotate around the recess 306 and the smaller head 306 and lock the two structural parts together. Suitable hardware is available from Hafele America Company as Capped Bolt, Minifix® System, Connector Housing, Häfele Minifix® 15, Zinc Alloy, without Rim, and Tightening Key, for Minifix® 15 RTA Cams.

A particular advantage to using this connecting system throughout is the benefit of not making screw or bolt that damage the structural pieces or the product holders. It also avoid overtightening which can damage structural parts made of particle board or plastic or the product holders which are preferable molded plastic.

What is claimed is:

1. A modular display unit comprising:
at least two structural supports;
at least one separator that is positioned between and connected to the at least two structural supports; and
at least two product holders, each product holder has a forward wall, a rear wall, and a plurality of product holding slots;
the plurality of product holding slots are supported on a bulbous base that extends between the forward wall and the rear wall, and supports a dependent side wall; and,
the base and dependent side wall of the at least two product holders cooperate to define respective receiving areas that each receive a portion of a respective one of the at least two structural supports,
whereby a product is displayed in a product holding location defined by opposed slots in the at least two product holders.

2. The modular display unit of claim 1 wherein the at least two product holders are mirror images of each other.

3. The modular display unit of claim 1 wherein each product holder includes at least two horizontal plates attached to the forward wall, each of the at least two horizontal plates includes reliefs for holding a placard.

4. The modular display unit of claim 1 further including a billboard attached to the at least one separator.

5. The modular display unit of claim 1 wherein the dependent side wall includes a plurality of fastener apertures for attaching the dependent side wall to a respective one of the at least two structural supports.

6. A modular display unit comprising:
at least two structural supports, each structural support has a lower edge; a first edge that is substantially perpendicular to the lower edge and has a first predetermined height, a second that is substantially perpendicular to the lower edge and has a second predetermined height that is greater than the first predetermined height; and, an upper edge that extends between the first and second predetermined heights and is at an angle with respect to the first edge;
at least one separator that is connected to the at least two structural supports and spaces the at least two structural supports apart by a predetermined distance; and,
at least two product holders, each product holder has a plurality of product holding slots that include a bulbous base, a first wall that is connected to the bulbous base at a first predetermined angle with respect to a centerline through the bulbous base and a second wall that is connected to the bulbous base at a second predetermined angle with respect to the centerline through the bulbous base that is greater than the first predetermined angle;
whereby a product placed in any one of the product holding slots is positioned above and movable within the bulbous base between resting positions defined by said first and second walls of the product holding slot.

7. The modular display unit of claim 6 wherein each product holder includes at least two horizontal plates, each of the at least two horizontal plates having notches for holding a placard.

8. The modular display unit of claim 6 further including a base plate that is connected to the at least two structural supports and spaces the at least two structural supports.

9. The modular display unit of claim 6 further including a point of sale billboard attached to the at least one separator.

10. The modular display unit of claim 6 wherein each structural support includes at least one notch in the lower edge.

11. The modular display unit of claim 10 further including a clip, wherein a base of the clip fits in the at least one notch.

12. The modular display unit of claim 6 wherein each product holder is connected to one of the at least two structural supports.

13. The modular display unit of claim 12 wherein the at least one separator is connected to the at least two structural supports and each product holder is connected to one of the at least two structural supports via pin and lock hardware.

* * * * *